US007086097B2

(12) United States Patent
Shin

(10) Patent No.: US 7,086,097 B2
(45) Date of Patent: Aug. 8, 2006

(54) PORTABLE URINAL FOR CHILDREN

(75) Inventor: Wook-Joong Shin, Suwon (KR)

(73) Assignee: Kowoo Co., Ltd., Osan (KR)

( * ) Notice: Subject to any disclaimer, the term of this patent is extended or adjusted under 35 U.S.C. 154(b) by 138 days.

(21) Appl. No.: 10/498,546

(22) PCT Filed: Sep. 4, 2003

(86) PCT No.: PCT/KR03/01818

§ 371 (c)(1),
(2), (4) Date: Jun. 14, 2004

(87) PCT Pub. No.: WO2005/004692

PCT Pub. Date: Jan. 20, 2005

(65) Prior Publication Data

US 2005/0251902 A1 Nov. 17, 2005

(51) Int. Cl.
*A47K 11/00* (2006.01)

(52) U.S. Cl. ..... 4/144.2; 4/144.1

(58) Field of Classification Search ..... 4/144.1–144.3, 4/450–454, 462

See application file for complete search history.

(56) References Cited

U.S. PATENT DOCUMENTS

| | | | | |
|---|---|---|---|---|
| 2,315,390 | A * | 3/1943 | Billeb | 4/484 |
| 3,588,921 | A * | 6/1971 | Nagel | 4/245.4 |
| 4,759,086 | A * | 7/1988 | Booth-Cox | 4/451 |
| 4,899,399 | A | 2/1990 | Young | |
| 5,329,644 | A * | 7/1994 | Scott | 4/144.2 |
| 5,406,650 | A * | 4/1995 | Einbinder | 4/144.2 |
| 5,651,778 | A * | 7/1997 | Melius et al. | 604/385.19 |
| 6,209,142 | B1 * | 4/2001 | Mattsson | 2/403 |
| 6,789,277 | B1 * | 9/2004 | Spitzer | 4/451 |
| 2002/0004949 | A1 | 1/2002 | Spitzer | |

FOREIGN PATENT DOCUMENTS

| | | |
|---|---|---|
| JP | 2001-340260 | 12/2001 |
| KR | 1997-0005141 | 2/1997 |
| KR | 2001-0051773 | 6/2001 |
| KR | 20-0259508 | 12/2001 |

* cited by examiner

*Primary Examiner*—Huyen Le
(74) *Attorney, Agent, or Firm*—IPLA P.A.; James E. Bame

(57) ABSTRACT

A shape of a disposable urinal for children that can be folded to be a small pack before use to be easily carried while securing a sufficient discharging length considering urine discharging directions in a narrow space such as in a car while driving a car or under a circumstance that it is hard to go to a restroom. A disposable portable urinal in which water-impermeably waterproof-coated boards and absorbents are layered, is characterized by comprising a urinal body having erected urine leak prevention walls, extending from edges of a long rectangular board having a body board and a lower board of the urinal, in order to have an inner space for containing urine; and absorbents attached to the body board and the lower board of the inner space to absorb all the urine, and characterized in that the body board and the lower board of the urinal body are folded to be perpendicular to each other.

11 Claims, 6 Drawing Sheets

PORTABLE URINAL FOR CHILDREN

CROSS-REFERENCES TO RELATED APPLICATIONS

This application corresponds to International Application No. PCT/KR03/001818, filed Sep. 4, 2003, which claims benefit of Korean Application Serial No. 20-2003-0022731, filed Jul. 14, 2003, the entire disclosures of which are hereby incorporated by reference.

TECHNICAL FIELD

The present invention relates to a disposable portable urinal for children in which absorbents are attached to water-impermeably waterproof-coated paperboards, and more particularly to a structure of a portable urinal for children that can be conveniently used outdoors without restrooms or in a car under very congested traffic.

BACKGROUND ART

In a place under very congested traffic in case of long-distance travel by car during a festive season or holidays, or when it is not possible to go to a restroom for a long time, it is a very serious trouble to relieve oneself for urgent needs. Particularly, it is almost impossible to request a child to retain his water for a long time, and a need for urgent urination is a serious problem.

Therefore, portable urinals using an absorbent of a highly polymerized compound have been lately proposed, but the entries of the conventional portable urinals are shaped without considering user's urine directions.

A man may have an experience that his urine is discharged from an upper left direction into a right down direction or an upper right direction into a left down direction, that is, his urine is discharged into unintentional directions when urinating into a diagonal direction, causing the urine to be splashed about. If the length of the urinal is extended recklessly for all that, it is inconvenient to carry and not easy to handle the urinal after use.

A registered device for a portable urinal (Registration No. 20-025908) is disclosed in the Utility Model Publication. The urinal of the registered device is structured to dispose of feces and urine, in which an absorbent layer is attached to a bag whose upper portion is open and which has the bag in order to have an inner space to contain feces and urine, but does not consider discharged direction of user's urine at all, so that urine is disadvantageously splashed about when the urinal is used in a narrow place such as in a car or when a child who is yet unskillful to control his body uses it.

A patent application for a disposable product to handle body fluids is disclosed in the open patent publication (Publication No. Pat. 2001-0051773). The applied invention improves a diaper that fits well to a corresponding part of a user's body and to which a pad is attached in order not to easily come off. However, the diaper must be put on for relieving himself or removed from the user's body. It is also unreasonable for either an adult or a child to use the diaper for infants without modification.

DISCLOSURE OF INVENTION

It is an object of the present invention to provide a portable urinal for children by which urine is not splashed about because a sufficient length considering directions of discharged urine is secured if the small pack-shaped urinal is spread when used in a narrow space such as in a car, as a urinal used while driving a car or in a case when it is not easy to go to a restroom.

Therefore, the present invention is characterized by a paperboard structure folded to be spread sufficiently in a vertical direction in use. According to the invention, when the portable urinal is spread, the length in the vertical direction at the body board of the urinal can be at least two times or more than that before the pack-shaped urinal is used, so that it is easy to carry the folded urinal before use, and the urinal can accept the urine discharged into an unintentional direction in use.

It is also another object of the invention to provide a urinal structure in which a collecting vinyl-bag can be turned inside out to put the urinal into the collecting vinyl-bag so that the used urinal can be easily preserved and handled, and further to provide a portable urinal according to the present invention in a simple and inexpensive manner.

The present invention to achieve the aforementioned technical subject is characterized by a portable urinal for children in which an absorbent is attached to a water-impermeable waterproof-coated paperboard, comprising: a urinal body in which urine leak prevention walls, laterally extending from edges of a long board having a body board and a lower board of the urinal, are erected to have an inner space for containing urine; and absorbents attached to the body board and the lower board in the inner space to absorb urine, and characterized in that the angle where the body board and the lower board of the urinal body meet each other is generally 90° or less. It is desirable that the urine leak prevention walls of the urinal body extending from all edges of the long board having the body board and the lower board of the urinal are erected. And it is more preferred that the body board and the lower board meet at a right angle each other and are supported on a bottom.

It is further desirable that a part of the urine leak prevention wall is folded inside to allow the inner surface of the urinal body to be bent toward a urinating person and to be concave.

Also, it is preferable to form a folding line to allow the urine to flow along a vertical central line formed in the longitudinal direction of the inner surface of the urinal body. It is preferable to be able to produce the urinal body before urination or to fold the urinal body inward after urination, and preferable that the urinal body is shaped to be a pack before spreading or after folding it. It is preferable that, while the urinal body is folded, the length in a vertical direction of the portable pack-shaped urinal is reduced to be one half or shorter than one half of the length in the vertical direction while it is spread. The invention is characterized in that a bag with binding portions extending in a shape of an opening for a general refuse bag is attached to the rear side of the urinal body and said bag is turned inside out so that the used portable pack-shaped urinal can be disposed.

Further preferably, the invention is characterized in that the thickness of the absorbent attached to the lower board surface of the urinal body is at least two or more times of the length of the absorbent attached to the body board surface of the urinal, and a deordorant and a germicide are further contained in the absorbent.

BRIEF DESCRIPTION OF THE DRAWINGS

These and other features, aspects, and advantages of the present invention will help better understanding with regard to the following description, appended claims, and accompanying drawings. In the drawings:

BEST MODE FOR CARRYING OUT THE INVENTION

Hereinafter, the embodiments of the present invention will be described in detail with reference to the accompanying drawings.

Figure 1:
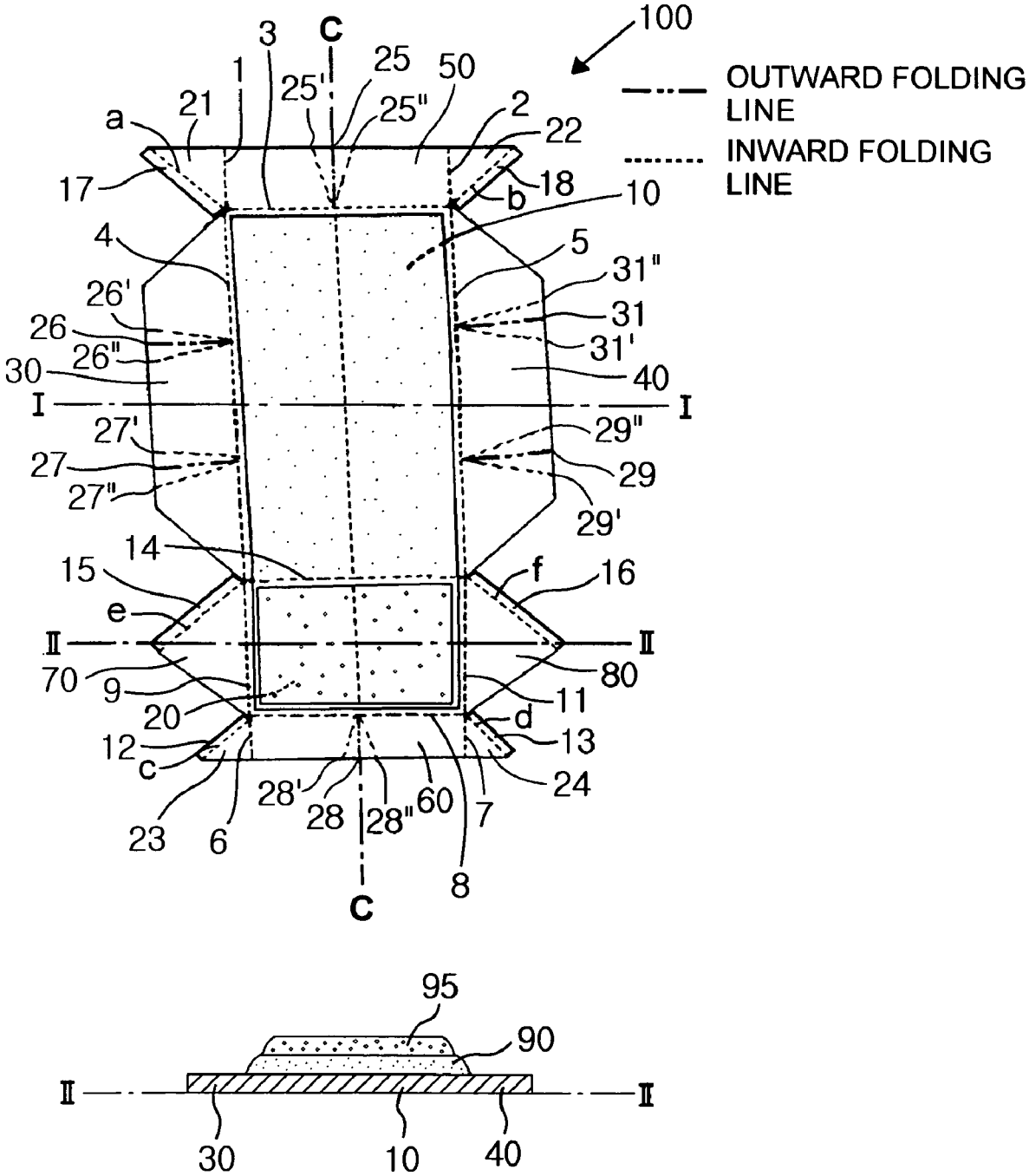
FIG. 1 is a spread view of a portable urinal in an embodiment according to the invention.

FIG. 1 is a spread view of a portable urinal of an embodiment according to the invention, illustrating a method of making the urinal and showing the layered structure of absorbents attached to a body board surface and a lower board surface of the urinal in a section across the line II—II.

The boards 10, 20, 30, 40, 50, 60, 70 and 80 shown in FIG. 1 are made of thick water-impermeably coated boards similar to the material for making a carton pack for milk. The absorbents 90 and 95 make an absorbent layer composed of a super-strong absorbent polymer and pulp, employed generally in a paper diaper or a pad. The absorbent 90 is attached to the body board surface 10 and the lower board surface 20 of the portable urinal or an absorbent 95 is further layered on the lower board surface 20 or the thickness of the absorbent is doubled to absorb urine sufficiently. Furthermore, it is desirable to add a deordorant or an aromatizer to the absorbent.

Now, referring to the spread view in FIG. 1, a method of folding the portable urinal using paperboards will be described according to an embodiment of the invention. One embodiment of the invention comprises: the long rectangular body board 10 of the urinal along which discharged urinal flows down; the lower board 20 of the urinal extended in a vertical direction from the body board 10; urine leak prevention walls 30, 40, 50, 60, 70 and 80 extending from the edges of the rectangular body board made of the two boards; urine leak prevention walls 21 and 22 extending towards the wings from the upper wall 50 that is one of the urine leak prevention walls; urine leak prevention walls 23 and 24 extending towards the wings from the lower wall 60; and absorbents 90 and 95 for absorbing urine. Here, a modified embodiment for removing the upper urine leak prevention wall 50 and the lower leak prevention wall 60 is also allowed.

First, the paperboard of the body board is shaped to be a rectangle long in a given direction by the vertical central axis C. The urine leak prevention walls 21 and 22 extending towards the wings from the upper urine leak prevention wall 50 are folded inside along the two folding lines 1 and 2 parallel to the vertical central axis C and also isodistantly spaced from the vertical central axis C on the upper urine leak prevention wall 50. In this case, the urine leak prevention walls 23 and 24 extending towards the wings from the lower urine leak prevention wall 60 are also folded toward the inside along the folding lines 6 and 7 in the same manner as the above.

Thereafter, the upper urine leak prevention wall 50 and the lower urine leak prevention wall 60 are folded, respectively, along the folding line 3 at the upper urine leak prevention wall 50 and along the folding line 8 at the lower urine leak prevention wall 60, the folding lines 3 and 8 being perpendicular to the vertical central axis C, parallel to the horizontal central axis I crossing over the whole width of the body board of the urinal, and isodistantly spaced from the horizontal central axis I.

The lateral urine leak prevention walls 30 and 40 are then folded, respectively, for the two folding lines 4 and 5 isodistantly spaced from the vertical central axis C at the body board of the urinal 10. At the lower board 20 of the urinal, the urine leak prevention walls 70 and 80 are then folded, respectively, along the two folding lines 9 and 11 isodistantly spaced from the vertical central axis C.

The outer surfaces of two tabs 17 and 18, respectively extending from the urine leak prevention walls 21 and 22 at the wings of the upper urine leak prevention wall 50, are joined with the upper inclined edge side lines of the lateral urine leak prevention walls 30 and 40 of the body board 10 of the urinal. In this case, various joining means may be used.

The outer surfaces of two tabs 12 and 13, respectively extending from the urine leak prevention walls 23 and 24 at the wings of the lower urine leak prevention wall 60, are joined with the lower inclined edge side lines of the lateral urine leak prevention walls 70 and 80 of the lower board 20 of the urinal. In this case, various joining means may be used.

Subsequently, the lower board 20 of the urinal is folded along the folding line 14 at the lower board 20 of the urinal, the folding line 14 being isodistantly spaced from the horizontal central axis I. Then, the outer surfaces of two tabs 15 and 16, respectively extending from the lateral urine leak prevention walls 70 and 80 of the lower board 20 of the urinal, are joined with the lower inclined edge side lines of the lateral urine leak prevention walls 30 and 40 of the body board 10 of the urinal, in order to complete a portable urinal.

In addition, it is desirable to fold the walls slightly outward along the folding lines 25, 26, 27, 28, 29 and 31 on the respective urine leak prevention walls 30, 40, 50 and 60 in order to receive urine well by the shape of the inwardly bent urinal, and to fold the body board 10 of the urinal slightly for the vertical central axis C in order to form a urine flow line.

For easy description, the same reference numerals indicated in FIG. 1 are used for depicting the same components.

Figure 2:
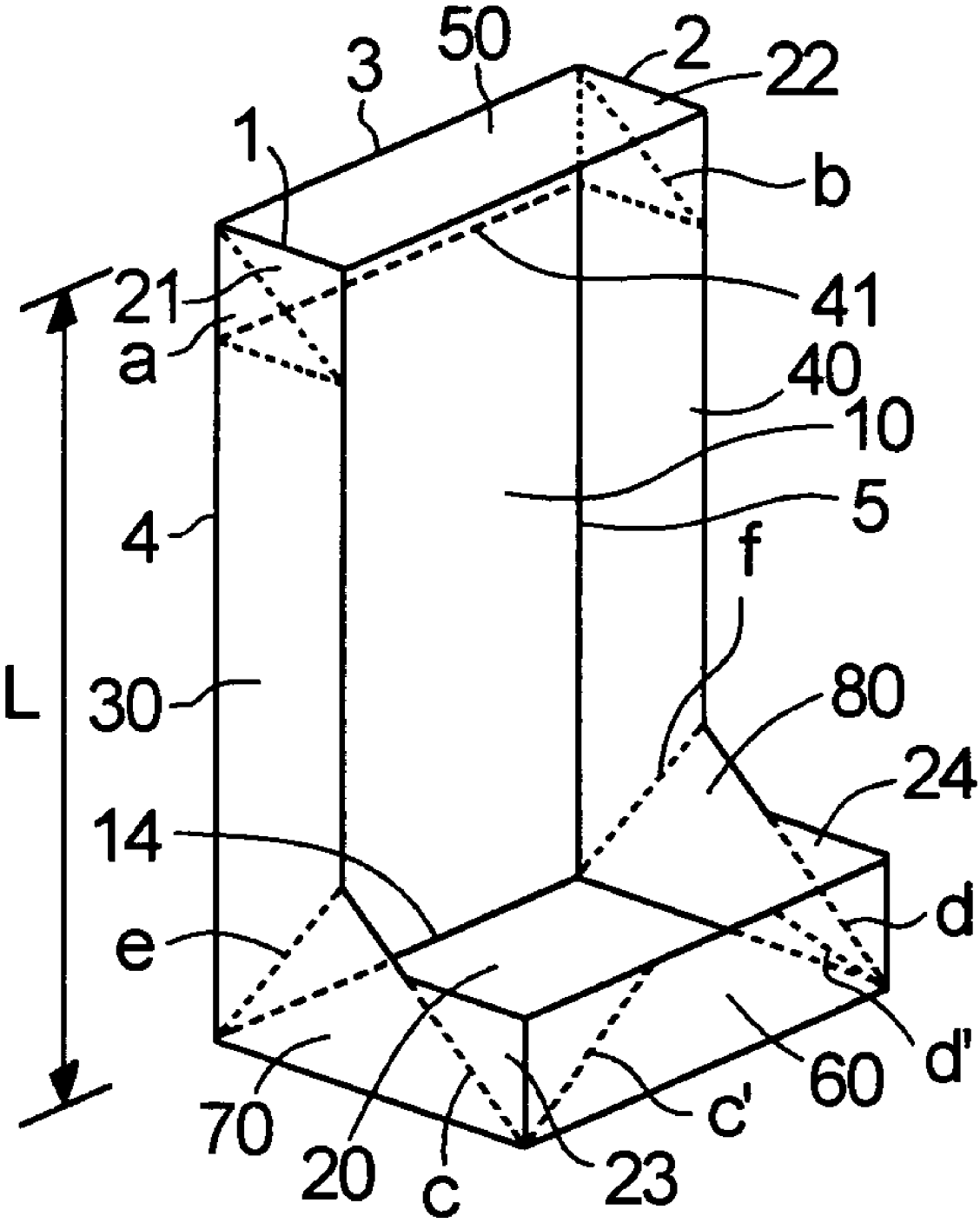
FIG. 2 is a perspective view of a portable urinal made according to the spread view in FIG. 1.
Figure 6:
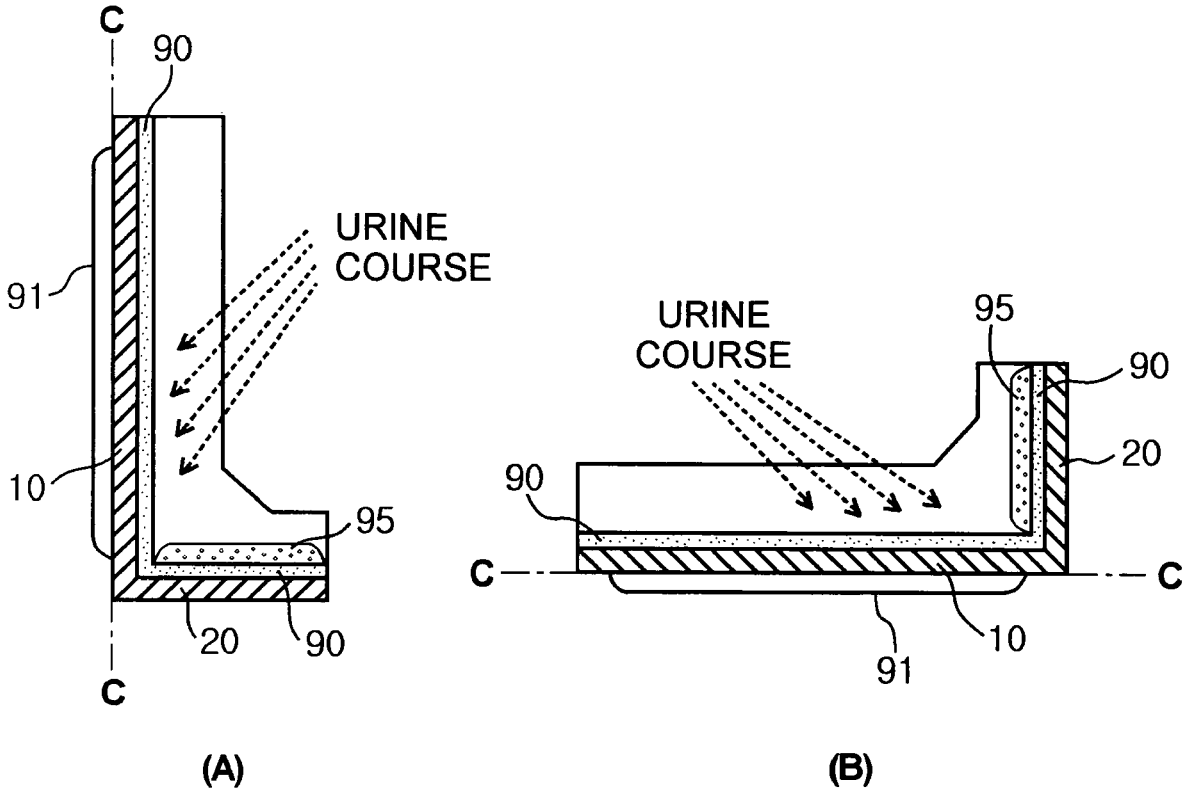
FIG. 6 is a sectional view showing the different state of the portable urinal of FIG. 2, used by a man and a woman.

The completed urinal is shown in FIG. 2. The state of using the portable urinal is shown in FIG. 6, illustrating different use between men and women.

Depending on the difference in physical structure between men and women, it is desirable that the lower board 20 of the portable urinal 100 is used as a bottom, and the body board 10 of the urinal as a wall for men or baby boys in an erected shape, as shown in FIG. 6A. It is also desirable that the body board 10 of the portable urinal 100 is used as a bottom, and the lower board 20 of the urinal as a wall for women or baby girls in a laid shape, as shown in FIG. 6B. This is conceived from the different shapes of toilets for men and women.

Figure 3:
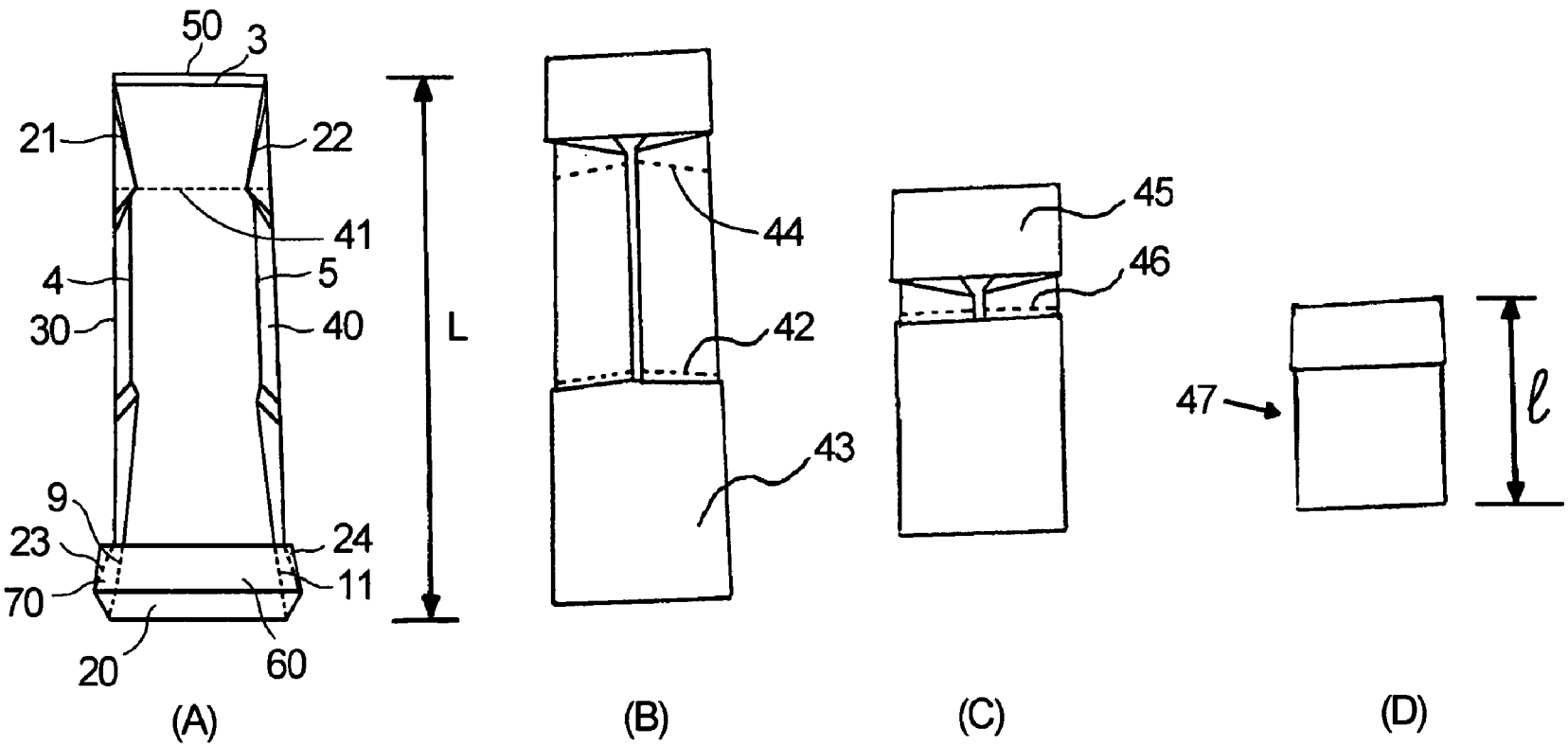
FIG. 3 shows a schematic showing a pack-shaped urinal made before using the portable urinal in FIG. 2 or a folded shape after use, according to an embodiment of the invention.
Figure 4:
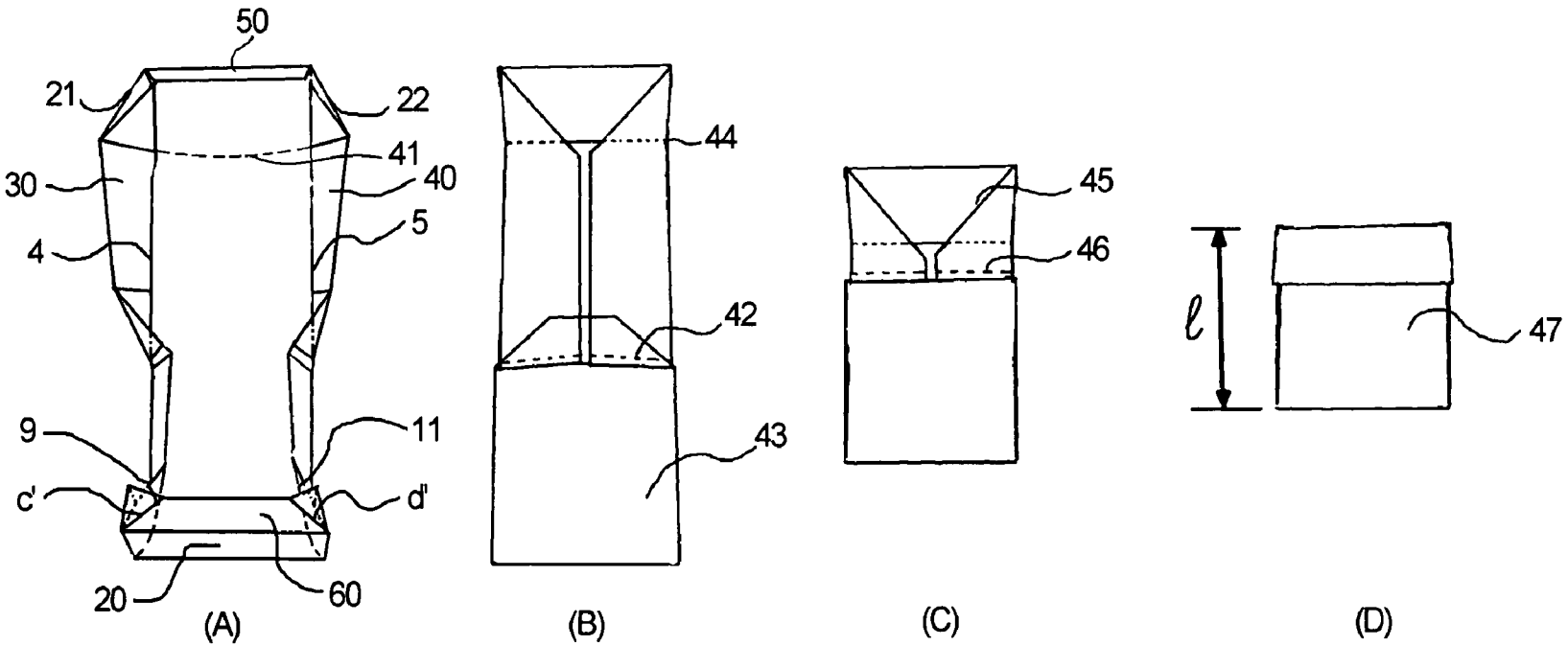
FIG. 4 shows a schematic showing a pack-shaped urinal made before using the portable urinal in FIG. 2 or a folded shape after use, according to another embodiment of the invention.

FIG. 2 is a perspective view of a portable urinal completed according to the spread view of FIG. 1. FIG. 3 is a schematic showing a pack-shaped portable urinal before using the urinal or a folded shape after use, according to one embodiment of the portable urinal in FIG. 2. FIG. 4 is a schematic showing a pack-shaped portable urinal before using the urinal or a folded shape after use, according to another embodiment of the portable urinal in FIG. 2. FIGS. 3 and 4 only show different folding methods. If described on the basis of FIG. 3 by means of the same reference numerals, the folding method of FIG. 4 will be fully understood accordingly.

FIG. 3 and FIG. 4 illustrate the method of making a portable urinal before use or pack-shaped folding of the portable urinal after use in order of A-B-C-D. The method of spreading the pack-shaped urinal illustrated in FIG. 3D before use will be understood in reverse order of the folding method described later, and spreading the urinal is thus not described in detail.

With reference to FIG. 2 and FIG. 3A, the lateral urine leak prevention walls 21 and 22 at the wings of the upper urine leak prevention wall 50 of the portable urinal to which absorbents that absorb urine are attached are folded fully toward the inside along the folding lines 1 and 2. The upper urine leak prevention wall 50 is folded by 180° fully toward the inside. In another embodiment of FIG. 4, with reference to FIG. 4A, while spreading the lateral urine leak prevention walls 30 and 40 to the right and left, the upper urine leak prevention wall 50 is folded toward the inside and the lateral urine leak prevention walls 30 and 40 folded along the folding lines 1 and 2 are folded toward the inside, respectively. The folded shape is shown in FIG. 4B. This folded shape in FIG. 4B is different from that in FIG. 3B in the upper part.

The lateral urine leak prevention walls 23 and 24 at the wings of the lower urine leak prevention wall 60 and the lateral urine leak prevention walls 70 and 80 of the lower board 20 of the urinal are folded fully toward the inside along the folding lines 6 and 7 and the folding lines 9 and 11, respectively. The lower urine leak prevention wall 60 and the lower board 20 of the urinal are folded fully toward the inside by 180° along the folding line 8 and the folding line 14, respectively. Another embodiment of FIG. 4 is identical to the embodiment of FIG. 3, except that the lateral urine leak prevention walls 23 and 24 at the wings of the lower urine leak prevention wall 60 are folded along the folding lines c' and d', and the folded lower urine leak prevention wall 60 is folded fully toward the inside.

When folding the upper urine leak prevention wall 50 and the lower board 20 of the urinal, the lateral urine leak prevention walls 30 and 40 are simultaneously folded toward the inside along the folding lines 4 and 5, respectively, fully by 180°. The aforementioned folded shape is shown in FIG. 3B. In FIG. 3B, the folded board 43 is folded inside fully by 180° along the folding line 42 located at the end of the folded lower board of the urinal. The folded shape is shown in FIG. 3C. In FIG. 3C, the folded board 45 being the folded upper urine leak prevention wall is folded fully toward the inside by 180° along the folding line 46 located at the end of the folded board 43. A fully folded and completed portable urinal pack 47 is shown in FIG. 3D. In this case, the length l in the vertical direction is one half or shorter than one half of the length L in the vertical direction of the spread urinal before use. In this case, for easy folding in the aforementioned process, respective folding lines are preformed on the portable urinal.

Figure 5:
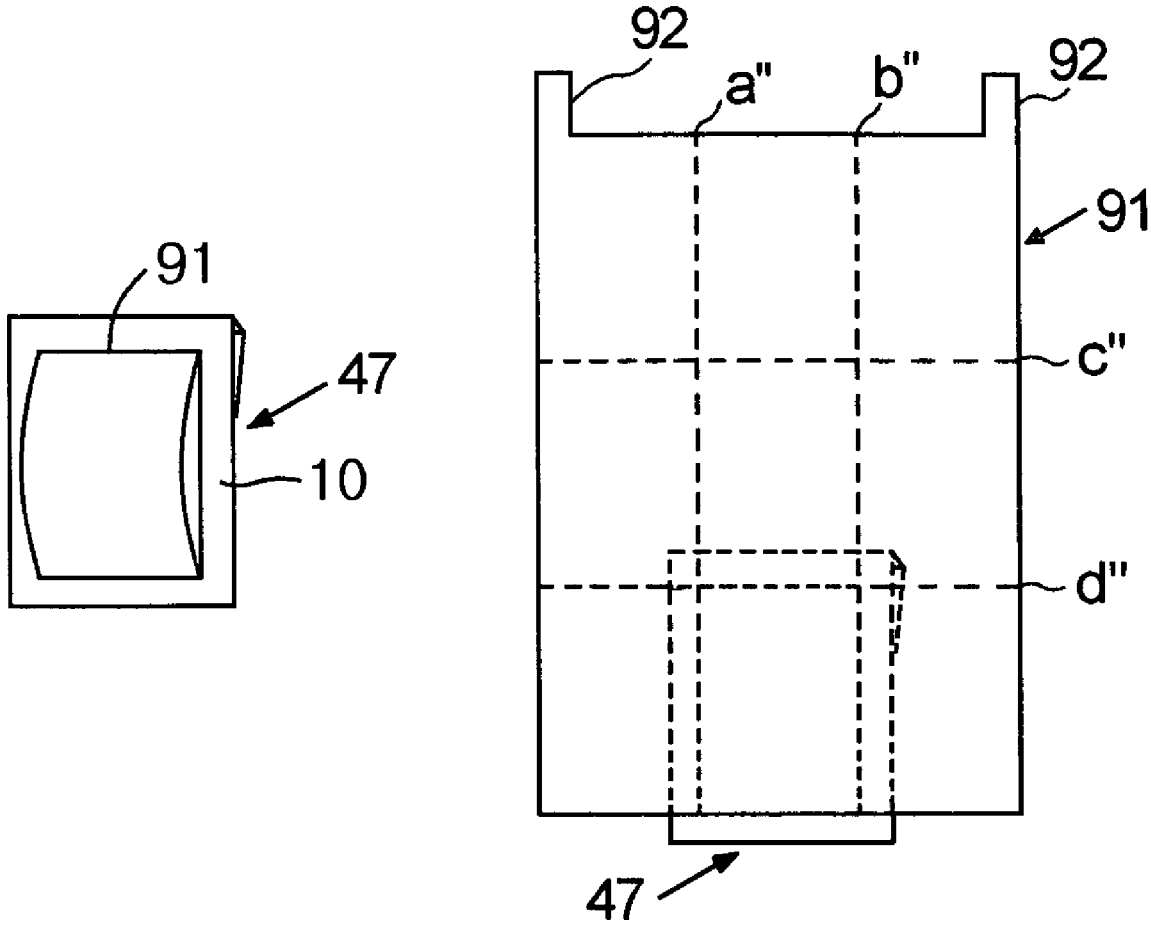
FIG. 5 shows a schematic showing a shape in which a collecting vinyl-bag is attached to the back of the pack-shaped urinal of FIG. 3 or FIG. 4.

FIG. 5 is a schematic showing a folded collecting vinyl-bag attached at the back of the pack-shaped urinal of FIG. 3 and a spread collecting vinyl-bag. In one embodiment of the invention, the collecting vinyl-bag 91 is attached at the back of the pack-shaped urinal in order to temporarily preserve the used portable urinal. Since a refuse bag-shaped collecting vinyl-bag with binding portions 92 projecting on the opening is provided, it is possible to seal the used urinal by binding the binding portions 92 together when turning the inside of the vinyl bag out and covering the used pack-shaped urinal. If the collecting vinyl-bag 91 shown on the right in FIG. 5 is folded along the folding lines a", b", c" and d" formed by dividing one surface of the collecting vinyl-bag 91 into nine portions, the collecting vinyl-bag 91 attachable to a small pack-shaped urinal shown on the left in FIG. 5 is made.

As described in the above, with a portable urinal according to the invention, it is easy to carry and handle the urinal because the urinal can become a folded small pack before or after using the urinal while securing a sufficient urine-discharging length considering discharging directions in a narrow space such as in a car while driving a car or under a circumstance that it is hard to go to a restroom.

Since the used urinal can be put into the collecting vinyl-bag by turning the inside of the collecting vinyl-bag out, easy preservation and handling is achieved. It is also simple and cheap to make the portable urinal because it is made of paperboards.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention claimed is:

1. A portable urinal for children made of water-impermeably waterproof-coated paperboards to which absorbents are attached, comprising:

a urinal body having erected urine leak prevention walls, extending laterally from edges of a long board having a body board and a lower board of the urinal, in order to have an inner space for containing urine; and absorbents attached to the body board and the lower board of the inner space to absorb all the urine, wherein the angle where the body board and the lower board of the urinal body meet is generally 90° or less, and wherein a refuse bag-shaped bag with binding portions projecting on the outside surface of the edge of an opening of the bag is attached to the rear side of the urinal body and the used pack-shaped urinal can be handled by turning the inside of the bag out.

2. The portable urinal as claimed in claim 1, wherein the urine leak prevention walls of the urinal body extending from all edges of the long board having the body board and the lower board of the urinal are erected.

3. The portable urinal as claimed in claim 1, wherein the body board and the lower board of the urinal meet at a right angle each other.

4. The portable urinal as claimed in claim 1, wherein a part of the urine leak prevention walls is folded inside to allow the inner surface of the urinal body to be bent toward a urinating person and to be concave.

5. The portable urinal as claimed in claim 1, wherein a folding line is formed to allow urine to flow along a vertical central line formed in the longitudinal direction of the inner surface of the urinal body.

6. The portable urinal as claimed in claim 1, wherein if the pack-shaped portable urinal is spread, it is shaped to be a urinal in use.

7. The portable urinal as claimed in claim 6, wherein while the urinal body is folded, the length in a vertical direction of the portable pack-shaped urinal is reduced to be one half or shorter than one half of the length in the vertical direction while it is spread.

8. The portable urinal as claimed in claim 1, wherein the urinal body can be folded inside after urination, and in that the urinal body is shaped to be a pack after folding it.

9. The portable urinal as claimed in claim 8, wherein while the urinal body is folded, the length in a vertical direction of the portable pack-shaped urinal is reduced to be one half or shorter than one half of the length in the vertical direction while it is spread.

10. The portable urinal as claimed in claim 1, wherein the thickness of the absorbent attached to the lower board surface of the urinal body is at least two or more times of the thickness of the absorbent attached to the body board surface of the urinal.

11. The portable urinal as claimed in claim 1, wherein a deordorant and a germicide are further contained in the absorbent.

* * * * *